US006019660A

United States Patent [19]

Luciano

[11] Patent Number: 6,019,660

[45] Date of Patent: Feb. 1, 2000

[54] BALLOON FOR INTERLOCKING WITH ANOTHER BALLOON

[76] Inventor: Ismael Luciano, 3420 N. Lee St., Philadelphia, Pa. 19134

[21] Appl. No.: 09/176,285

[22] Filed: Oct. 21, 1998

[51] Int. Cl.[7] ..... A63H 3/06

[52] U.S. Cl. ..... 446/220; 446/223

[58] Field of Search ..... 446/220, 221, 446/223, 225, 226

[56] References Cited

U.S. PATENT DOCUMENTS

| | | | |
|---|---|---|---|
| 1,483,150 | 2/1924 | Witten . | |
| 1,642,022 | 9/1927 | Groh . | |
| 2,008,552 | 7/1935 | Jacobs . | |
| 2,722,774 | 11/1955 | Andreadis | 446/223 |
| 2,826,000 | 3/1958 | Fischman et al. . | |
| 3,358,398 | 12/1967 | Chalfin . | |
| 3,626,634 | 12/1971 | Jones et al. . | |
| 4,213,267 | 7/1980 | Curtis . | |
| 4,881,916 | 11/1989 | Houser | 446/222 |
| 4,892,500 | 1/1990 | Lau | 446/221 |
| 4,934,986 | 6/1990 | Wallace | 446/222 |
| 5,031,908 | 7/1991 | Spector | 273/447 |
| 5,127,867 | 7/1992 | Lau | 446/221 |
| 5,169,353 | 12/1992 | Myers | 446/221 |
| 5,238,231 | 8/1993 | Huang | 267/35 |
| 5,282,768 | 2/1994 | Akman | 446/220 |
| 5,546,707 | 8/1996 | Caruso | 52/213 |
| 5,628,091 | 5/1997 | Mueller | 24/3.2 |

FOREIGN PATENT DOCUMENTS

| | | | |
|---|---|---|---|
| 2300128 | 10/1996 | United Kingdom | 446/220 |

*Primary Examiner*—Robert A. Hafer
*Assistant Examiner*—Laura Fossum
*Attorney, Agent, or Firm*—Richard L. Miller, P.E.

[57] ABSTRACT

A balloon for interlocking with another balloon that includes a body of an elastically expansible material formed into a substantially closed shape so as to define an expansible chamber therein, inflation apparatus for allowing a pressurized gas to enter and inflate the body, and interlocking apparatus for allowing one balloon to interlock with another balloon. The inflation apparatus includes a pair of tubes of an elastically expansible material and which extend axially and collinearly from, and are integrally formed with, opposing ends of the body and terminate in open ends with circumferential lips, and are in fluid communication with the expansible chamber for allowing the pressurized gas to enter and inflate the expansible chamber. The interlocking apparatus includes the inflation apparatus being tied by a string after the body is inflated, and with the string tying the inflation apparatus of one balloon also tying the inflation apparatus of an adjacent balloon so as to from a chain of balloons. In another embodiment, one tube of the pair of tubes has a closed end and a diameter less than that of the other tube which has an open end so as to allow the one tube of one balloon to interlockingly fit in the other tube of an adjacent balloon.

3 Claims, 1 Drawing Sheet

FIG. 1
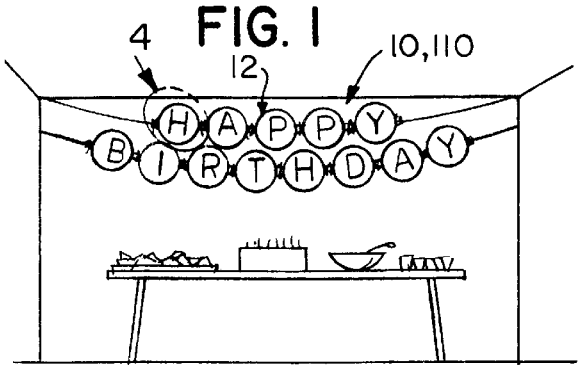
FIG.2
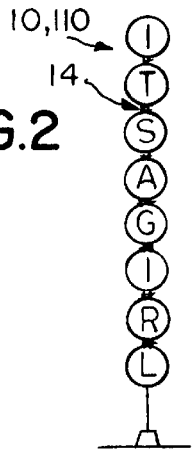
FIG.5
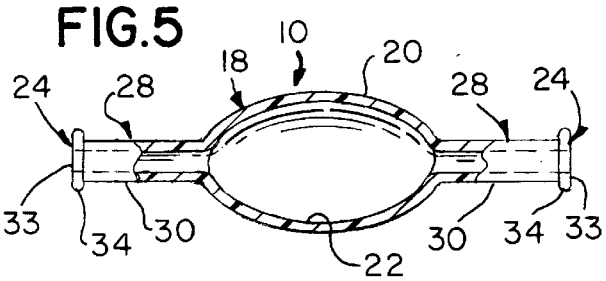
FIG.3
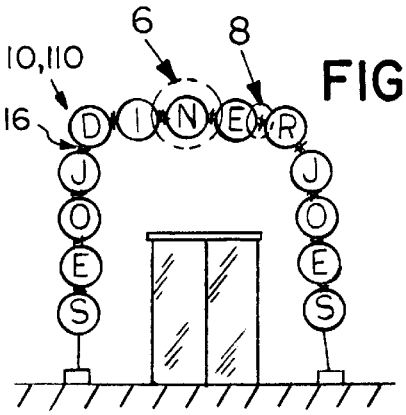
FIG.7
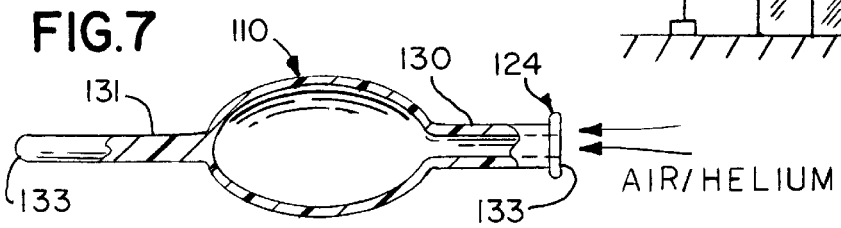
FIG.8
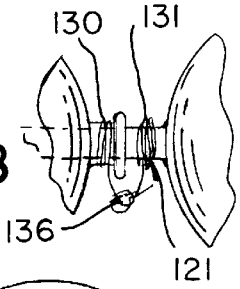
FIG.4
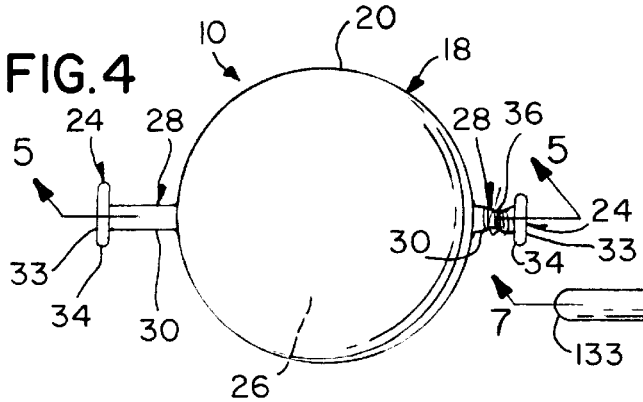
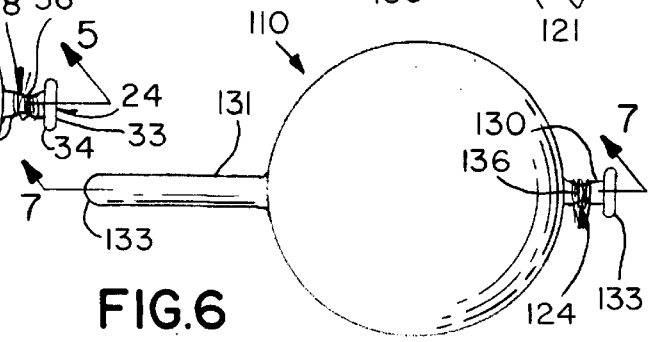
FIG.6

BALLOON FOR INTERLOCKING WITH ANOTHER BALLOON

BACKGROUND OF THE INVENTION

1. Field of the Invention

The present invention relates to a balloon. More particularly, the present invention relates to a balloon for interlocking with another balloon.

2. Description of the Prior Art

Numerous innovations for inflatable related devices have been provided in the prior art that will be described. Even though these innovations may be suitable for the specific individual purposes to which they address, however, they differ from the present invention.

A FIRST EXAMPLE, U.S. Pat. No. 4,934,986 to Wallace teaches an inflatable balloon including an elastically expansible material formed into a closed shape so as to define an expansible chamber therein, the material having an inflation opening for supplying a pressurized gas thereto so as to inflate the material; an upper eye unit having an upper portion and a lower portion partially depressed into a top portion of the material substantially opposite to the inflation opening so that the top portion of the material surrounds the lower portion of the upper eye unit and the upper portion extends out from the material and by which the balloon can be connected to another object; a cylindrical tubular valve extending partially into the inflation opening for supplying the pressurized gas to the chamber, the valve including an inflation channel providing fluid communication between the chamber and ambient atmosphere; a plug insertable into the valve for closing the inflation channel; a lower connecting loop unit secured to a lower portion of the valve that extends from the inflation opening for securing the balloon to another object; and a strengthening joiner cord contained entirely inside of the chamber for connecting the upper eye unit to the valve when the balloon is inflated and for strengthening the balloon when inflated.

A SECOND EXAMPLE, U.S. Pat. No. 5,031,908 to Spector teaches a game set for ceiling play composed of a shaped lighter-then-air master balloon tethered to a line to be held by the player, and a group of shaped lighter-then-air, free-floating slave balloons which when released rise to the ceiling of a play room. The respective balloon shapes and their number are appropriate to the game. Thus, in a fishing game, the shapes of the slave balloons are those of different species of fish, and that of the master balloon is of a standard float at the end of a fishing line. Attached to the surface of the master balloon is a patch forming one element of a velcro fastener, and attached to the surface of each slave balloon is a patch forming the complementary element. In ceiling play, the player seeks by manipulating the tethered master balloon to position it so that the patch thereon engages the complementary patch on a selected slave balloon on the ceiling, at which point the caught slave balloon can be brought down form the ceiling.

A THIRD EXAMPLE, U.S. Pat. No. 5,546,707 to Caruso teaches an inflatable tube system, having an inflatable tube in the shape of a cylinder having two ends and a shaft. The tube includes a bladder, made of an elastometer in the shape of a cylinder, and a fabric covering made of woven polyethylene, the fabric covering enclosing the bladder. A pair of end closures sealing the fabric covering at the ends of the cylinder. An air valve extends into the bladder through one of the end closures.

A FOURTH EXAMPLE, U.S. Pat. No. 5,628,091 to Mueller teaches a balloon closure device that includes an integrally formed flat seal portion and removable tab portion (made of biodegradable material) and a loop of string or other type of line. The loop of string may be wrapped neatly around the tab portion, which eases handling of the device before it is used to seal a balloon. Once the device is used to seal a balloon, the loop of string may be used to secure the sealed balloon to the user's wrist without requiring the user to tie a knot.

It is apparent that numerous innovations for inflatable related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a balloon for interlocking with another balloon that avoids the disadvantages of the prior art.

ANOTHER OBJECT of the present invention is to provide a balloon for interlocking with another balloon that is simple and inexpensive to manufacture.

STILL ANOTHER OBJECT of the present invention is to provide a balloon for interlocking with another balloon that is simple to use.

BRIEFLY STATED, YET ANOTHER OBJECT of the present invention is to provide a balloon for interlocking with another balloon that includes a body of an elastically expansible material formed into a substantially closed shape so as to define an expansible chamber therein, inflation apparatus for allowing a pressurized gas to enter and inflate the body, and interlocking apparatus for allowing one balloon to interlock with another balloon. The inflation apparatus includes a pair of tubes of an elastically expansible material and which extend axially and collinearly from, and are integrally formed with, opposing ends of the body and terminate in open ends with circumferential lips, and are in fluid communication with the expansible chamber for allowing the pressurized gas to enter and inflate the expansible chamber. The interlocking apparatus includes the inflation apparatus being tied by a string after the body is inflated, and with the string tying the inflation apparatus of one balloon also tying the inflation apparatus of an adjacent balloon so as to from a chain of balloons. In another embodiment, one tube of the pair of tubes has a closed end and a diameter less than that of the other tube which has an open end so as to allow the one tube of one balloon to interlockingly fit in the other tube of an adjacent balloon.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows:

FIG. 1 is a diagrammatic perspective view of the present invention formed into a horizontal chain;

FIG. 2 is a diagrammatic perspective view of the present invention formed into a vertical chain;

FIG. 3 is a diagrammatic perspective view of the present invention formed into an inverted U-shaped chain;

FIG. 4 is an enlarged diagrammatic side elevational view of the area generally enclosed by the dotted circle identified by arrow 4 in FIG. 1 of a first embodiment of the present invention FIG. 5 is a cross sectional view taken on line 5—5 in FIG. 4 of the present invention prior to inflation;

FIG. 6 is an enlarged diagrammatic side elevational view of the area generally enclosed by the dotted circle identified by arrow 6 in FIG. 3 of a second embodiment of the present invention FIG. 7 is a cross sectional view taken on line 7—7 in FIG. 6 of the second embodiment of the present invention prior to inflation; and FIG. 8 is an enlarged side elevational view of the area generally enclosed by the dotted circle identified by arrow 8 in FIG. 3 of the interlocking of the second embodiment of the present invention.

LIST OF REFERENCE NUMERALS UTILIZED IN THE DRAWING

First Embodiment

10 balloon for interlocking with another balloon of the present invention
12 horizontal chain
14 vertical chain
16 inverted U-shaped chain
18 body
20 substantially closed shape of body 18
22 expansible chamber in body 18 defined by substantially closed shape 20 of body 18
24 inflation apparatus for allowing pressurized gas 26 to enter and inflate body 18
26 pressurized gas
28 interlocking apparatus for allowing one balloon of balloon for interlocking with another balloon 10 to interlock with another balloon of balloon for interlocking with another balloon 10
30 pair of tubes of inflation apparatus 24
33 open ends of pair of tubes 30 of inflation apparatus 24
34 circumferential lips on open ends 33 of pair of tubes 30 of inflation apparatus 24 for allowing pressurized gas 26 to enter and inflate expansible chamber 22 in body 18
36 string of interlocking apparatus 28

Second Embodiment

110 balloon for interlocking with another balloon 110
124 inflation apparatus
130 one tube of pair of tubes of inflation apparatus 124
131 tube of pair of tubes of inflation apparatus 124
133 end of tube 131 of pair of tubes of inflation apparatus 124
136 string

DETAILED DESCRIPTION OF THE PREFERRED EMBODIMENT

Referring now to the figures, in which like numerals indicate like parts, and particularly to FIGS. 1–3, respectively, the balloon for interlocking with another balloon of the present invention is shown generally at 10 for forming a horizontal chain 12, for forming a vertical chain 14, and for forming an inverted U-shaped chain 16.

The configuration of the balloon for interlocking with another balloon 10 can best be seen in FIGS. 4 and 5, and as such will be discussed with reference thereto.

The balloon for interlocking with another balloon 10 comprises a body 18 of an elastically expansible material formed into a substantially closed shape 20 so as to define an expansible chamber 22 therein.

The balloon for interlocking with another balloon 10 further comprises inflation apparatus 24 associated with the body 18 for allowing a pressurized gas 26 to enter and inflate the body 18.

The balloon for interlocking with another balloon 10 further comprises interlocking apparatus 28 associated with the body 18 for allowing one balloon of the balloon for interlocking with another balloon 10 to interlock with another balloon of the balloon for interlocking with another balloon 10.

The inflation apparatus 24 includes a pair of tubes 30 of an elastically expansible material that are elongated and slender and extend axially and collinearly from, and are integrally formed with, opposing ends 32 of the body 18, and terminate in open ends 33 with circumferential lips 34, and are in fluid communication with the expansible chamber 22 in the body 18 for allowing the pressurized gas 26 to enter and inflate the expansible chamber 22 in the body 18.

The interlocking apparatus 28 includes the inflation apparatus 24 being tied by a string 36 after the body 18 is inflated, and with the string 36 tying the inflation apparatus 24 of one balloon of the balloon for interlocking with another balloon 10 also tying the inflation apparatus 24 of an adjacent balloon of the balloon for interlocking with another balloon 10 so as to from the chain 12, 14, or 16.

The configuration of a second embodiment of the balloon for interlocking with another balloon 110 can best be seen in FIGS. 6–8, and as such will be discussed with reference thereto.

The balloon for interlocking with another balloon 110 is similar to the balloon for interlocking with another balloon 10, except that one tube of the pair of tubes 130 of the inflation apparatus 124 is replaced by a tube 131 that is slender and elongated, and whose end 133 is closed, and whose diameter is less than that of the other tube of the pair of tubes 130 so as to allow the tube 131 of the pair of tubes 130 of the inflation apparatus 124 of one balloon of the balloon for interlocking with another balloon 110 to interlockingly fit in the other tube of the pair of tubes 130 of an adjacent balloon of the balloon for interlocking with another balloon 110 whose end 133 is open, with the string 136 tying the other tube of the pair of tubes 130 of the adjacent balloon of the balloon for interlocking with another balloon 110 with the tube 131 of the pair of tubes 130 of the inflation apparatus 124 of the one balloon of the balloon for interlocking with another balloon 110 captured therein so as to from the chain 12, 14, or 16.

It will be understood that each of the elements described above, or two or more together, may also find a useful application in other types of constructions differing from the types described above.

While the invention has been illustrated and described as embodied in a balloon for interlocking with another balloon, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kit for forming a chain of balloons, the kit comprising:

a plurality of balloons, each balloon of said plurality of balloons having a body of an elastically expansible material formed into a substantially closed shape so as to define an expansible chamber therein, an inflation means for allowing a pressurized gas to enter and inflate the body, said inflation means being formed integrally with the body and being defined by an open tube of elastically expansible material having a first diameter, and an interlocking means for interlockingly fitting within the inflation means of another of said balloon, said interlocking means being formed integrally with the body and being defined by a solid closed tube having a second diameter which is less than said first diameter; and at least one piece of string, wherein said inflation means, said interlocking means, and said string are dimensioned and arranged so that after said body is inflated, said interlocking means is captured inside and interlocks within the inflation means, and said string is tied around said inflation means and said interlocking means thereby forming a chain of said balloons.

2. The kit as defined in claim 1, wherein said open tube and said closed tube of said balloons are each elongated and slender.

3. The kit as defined in claim 1, wherein said open tube and said closed tube of said balloons extend axially and collinearly from, and are integrally formed with, opposing ends of said body.

* * * * *